US006987451B2

(12) United States Patent
McKeown et al.

(10) Patent No.: US 6,987,451 B2
(45) Date of Patent: Jan. 17, 2006

(54) SURVEILLANCE SYSTEM WITH IDENTIFICATION CORRELATION

(75) Inventors: Steve McKeown, Campbellford (CA); Bruce Gilkes, Calgary (CA)

(73) Assignee: 3rd Millennium Solutions. Ltd., Campbellford (CA)

( * ) Notice: Subject to any disclaimer, the term of this patent is extended or adjusted under 35 U.S.C. 154(b) by 75 days.

(21) Appl. No.: 10/726,989

(22) Filed: Dec. 3, 2003

(65) Prior Publication Data

US 2004/0160317 A1 Aug. 19, 2004

Related U.S. Application Data

(60) Provisional application No. 60/430,468, filed on Dec. 3, 2002.

(51) Int. Cl.
*G08B 13/00* (2006.01)

(52) U.S. Cl. ..... 340/541; 340/572.1; 340/573.1; 340/539.25; 340/825.36; 348/143; 348/150; 348/152

(58) Field of Classification Search ..... 340/541, 340/539.25, 572.1, 573.1, 825.36, 825.49; 348/143, 150–155
See application file for complete search history.

(56) References Cited

U.S. PATENT DOCUMENTS 5,309,144 A * 5/1994 Lacombe et al. ..... 340/539.23
5,321,396 A * 6/1994 Lamming et al. ..... 340/825.49
5,432,864 A * 7/1995 Lu et al. ..... 382/118
5,666,157 A 9/1997 Aviv
5,745,036 A * 4/1998 Clare ..... 340/572.1
6,028,626 A 2/2000 Aviv
6,219,613 B1 * 4/2001 Terrier et al. ..... 701/207
6,513,015 B2 * 1/2003 Ogasawara ..... 705/26

FOREIGN PATENT DOCUMENTS

WO 01/46923 6/2001
WO 02/23498 3/2002

OTHER PUBLICATIONS

WO 01/46923 A (Axcess Inc; Griebenow), Jun. 28, 2001, pp. 2, line 2- p. 3, line 8, p. 4, lines 22-23.*
WO/ 02/23498 A (Benadon; Lemaire; Technopuce), Mar. 21, 2002.*

* cited by examiner

*Primary Examiner*—Brent A. Swarthout
*Assistant Examiner*—Anne V. Lai
(74) *Attorney, Agent, or Firm*—Pearne & Gordon LLP

(57) ABSTRACT

A system and method for detecting, monitoring, and identifying objects within an area having at least one surveillance system and one position locating system for independently detecting and monitoring objects located within an area. The surveillance system information and the position locating system information is provided to the system, and the system compares the information to determine if they are the same object and if the object is authorized to be in the area. The system also notifies the system operator if the object is not authorized to be in the area or if the object is not being detected by all the surveillance and position locating systems.

13 Claims, 1 Drawing Sheet

SURVEILLANCE SYSTEM WITH IDENTIFICATION CORRELATION

RELATED APPLICATION

This application claims the benefit of U.S. Provisional Application No. 60/430,468, filed Dec. 3, 2002.

FIELD OF THE INVENTION

The present invention relates video surveillance system and radio frequency identification (RF-ID) filtering and, more particularly, to tracking movement and location of objects using video surveillance and RF-ID filtering systems.

BACKGROUND OF THE INVENTION

Currently, surveillance and security systems using radio frequency identification (RF-ID) tags or other radio frequency (RF) tracking systems can track the movement and location of objects and people that are wearing the tags within the margin or error for the device. However, these systems have no means of tracking people or objects that are not wearing the RF tracking tags. Similarly, some sophisticated video surveillance systems can detect and monitor the movement and location of objects within a given area. However, these video surveillance systems require a human interface to determine if the object or person should or should not be in a specific area. It would be desirable to resolve these problems of monitoring an area with video surveillance and determining if an object or person is authorized to be in that area.

SUMMARY OF THE INVENTION

The present invention provides a system for monitoring an area with surveillance system and determining if a person or object is authorized to be in that area by correlating the location of objects being tracked by the surveillance system, such as, but not limited to digital, non-digital and infra-red video, with those of a tracking system, such as a RF tracking system or similar devices like, but not limited to, a GPS and radio signal transceiver system. The system outputs a list of objects that are being monitored within a given area by the surveillance systems, and whether or not these objects are associated with the tracking tags, such as a RF tracking tag, being tracked by the monitoring and tracking systems. The system can then notify the system operator of an unauthorized object or person within a given area.

BRIEF DESCRIPTION OF THE DRAWINGS

Further features and details of the present invention will be apparent with reference to the following description and drawings.

DETAILED DESCRIPTION OF THE INVENTION

Figure 1:
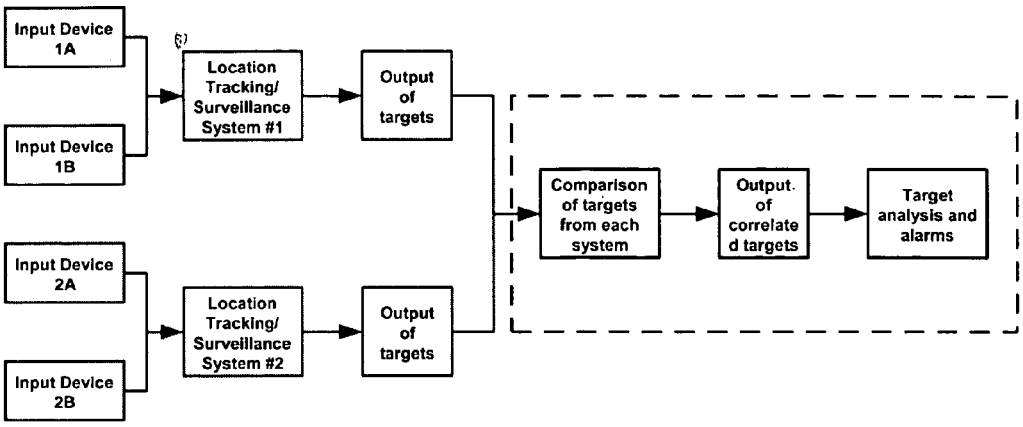
FIG. 1 is a block diagram of an embodiment of the invention.

As shown in FIG. 1, the system takes geo-spatial location information on multiple objects being provided by several different position location or tracking systems and surveillance systems and compares that information in relation to time and space to determine if each of the input systems is referring to the same target. Given that these position location systems and surveillance systems are able to locate and track an object within a given margin of error (e.g., plus or minus a certain distance), the system applies a logic algorithm to determine if each system is referring to the same object.

The resulting system output is a list of objects within the surveillance area, and whether or not each object is associated with a tracking tag, such as a RF tracking tag. The system identifies a multiple of objects, independently, within the designated area. The system also determines whether or not the tracking tag is authorized to be within that area.

The system may be connected to a number of surveillance systems or position locating systems that each independently generating location information on a number of different targets. These inputs can be provided from a number of different location collection devices, such as tracking systems, security cameras and surveillance systems. Surveillance systems include, but are not limited to digital, non-digital and infra-red video. Tracking systems include, RF tracking systems and similar devices like, but not limited to, GPS and radio signal transceiver systems.

The input to the system are geo-spatial location information in a variety of different forms (e.g., x and y coordinates, latitude and longitude, map grid reference, etc.), as well as a time stamp as to when the object was in a particular location. The input to the system is from a database or map that the surveillance system is using to track the location of a number of different objects within the area under surveillance.

The system takes the target information from each of the different systems and compares them to determine if they are referencing the same target. This comparison is done in relation to time and the relative position of the target. Due to the margin of error associated with the target positions for each of the inputting systems, the system uses a logic algorithm to determine if the inputting systems are referring to the same target. The system also determines if there are objects being detected by some inputting systems that are not being detected by other systems and flags these objects as requiring an operator's attention or an alarm may be given by sound, light, or other means by the system to notify the operator.

Figure 2:
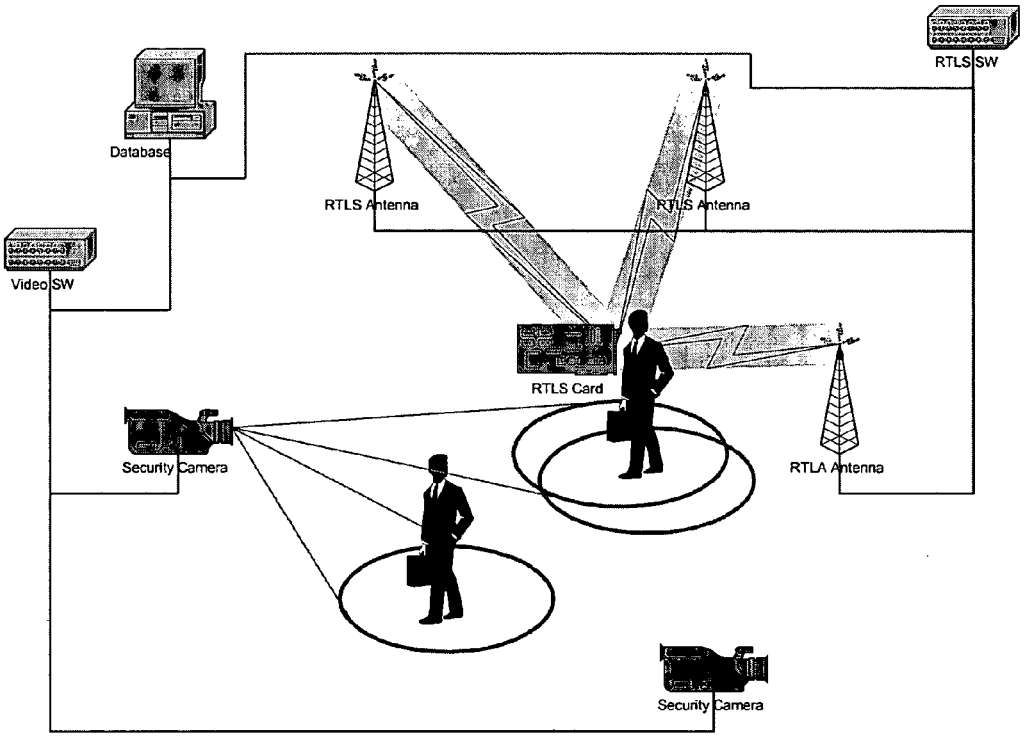
FIG. 2 is a diagram of a video surveillance system and a tracking system using an embodiment of the invention.

The invention may be used with both an object with an authorized tracking tag or an object without a tracking tag. As shown in FIG. 2, an embodiment of the invention is connected to a video surveillance system and a RFID, RTLS, or RF tracking system Both the video surveillance and RF tracking systems are capable of determining the location of objects within the area under surveillance and the time at which the object was in that location. However, both of these types of object tracking have inherent limitations. The video surveillance system requires a human interface to determine if the object or person should or should not be in a specific area, and the RF tracking system has no means of tracking objects that are not wearing the RF tracking tags.

In the first case, an object with a RF tracking tag that is authorized to be in the area enters the surveillance area. The RF tracking system detects the card, its location, and the time at which that location was determined. This tracking system information is provided to the system. At the same time, the video surveillance system detects the object and its location. This surveillance system information along with the time at which the object was at that location is provided to the system. The system takes these two pieces of information and determines the objects being detected by both systems are the same object and whether the object is authorized to be in that area.

In the second case, an object without a RF tracking tag enters the surveillance area. Because the object does not have a RF tracking tag, the RF tracking system does not detect it. The video surveillance system detects the object and passes the location and time the object was at that location to the system The system then determines that the object being detected by the video surveillance system is not associated with any of the RF tracking tags being tracked by the RF tracking system. The system then determines that object is not being authorized to be in that area. The object is flagged as requiring an operator's attention or an alarm may be given by sound, light, or other means by the system to notify the operator that the object is not authorized to be in the area.

Theft of a tracking tag or a badge, such as a RF-ID badge, is also prevented by timely user verification. At a designated time or location, each RF-ID badge user must identify themselves biometrically, such as by voice or fingerprint input. If such identification time or location is not completed by the user, a notification with the security system occurs to notify the operator, or an alarm may be given by sound, light, or other means by the system The designated time may be, for example, hourly, daily, such as at the beginning or ending of a worker's shift, or a predetermined time during the day.

The system is not tied to one specific input device such as a RF tracking system or a video surveillance. It can be used to compare objects being tracked by a number of different systems to determine which of the objects being tracked are the same and which are not.

While the invention has been described with reference to a specific embodiment, various changes may be made and equivalents may be substituted for elements thereof by those skilled in the art without departing from the scope of the invention. In addition, other modifications may be made to adapt a particular situation or method to the teachings of the invention without departing from the essential scope thereof.

What is claimed is:

1. A system for detecting, monitoring, and identifying objects within an area comprising;

at least one surveillance means and one position locating means for independently detecting and monitoring at least one object located within a predetermined area, means for recording data on a first object detected and monitored by the surveillance means located within the area, means for recording data on a second object detected and monitored by the position locating means located within the area, means for comparing the surveillance recorded data of the first object with the position locating recorded data of the second object to determine if the surveillance mean and the position locating means are referencing a same target, means for determining if the target is authorized to be in the area, and means for notifying an operator if the target is not authorized to be in the area.

2. The system of claim 1, wherein the surveillance means is a digital, non-digital or infra-red video surveillance system.

3. The system of claim 1, wherein the position locating means is a RF tracking, a GPS, or radio signal transceiver system.

4. The system of claim 1, wherein the comparison means uses a logic algorithm to compare the surveillance recorded data and the position locating recorded data.

5. The system of claim 1, wherein the position locating means detects and monitors objects with tracking tags.

6. The system of claim 1, further comprises means for notifying an operator when at least one of the first object is not detected by the surveillance means and the second object is not detected by the position locating means.

7. A method for detecting, monitoring, and identifying objects within an area comprising the steps of;

independently detecting and monitoring at least one object by at least one surveillance system and one position locating system, recording data on a first object detected and monitored by the surveillance system located within the area, and recording data on a second object detected and monitored by the position locating system located within the area, sending the recorded data on the first object and the recorded data on the second object to a database, comparing the recorded data of the first object with the recorded data of the second object in the database to determine if the first object and the second object is a same target, determining if the target is authorized to be in the area, and notifying an operator if the target is not authorized to be in the area.

8. The method of claim 7, wherein the surveillance system is a digital, non-digital or infra-red video surveillance system.

9. The method of claim 7, wherein the position locating system is a RF tracking, a GPS, or radio signal transceiver system.

10. The method of claim 7, wherein said comparing step uses a logic algorithm on a computer to compare the recorded data of the first object with the recorded data of the second object in the database.

11. The method of claim 7, wherein the position locating system detects and monitors objects with tracking tags.

12. The method of claim 7, further comprising the step of;

notifying an operator if at least one of the first object is not detected by the surveillance means and the second object is not detected by the position locating means.

13. The method of claim 7, further comprising the steps of;

continually detecting and monitoring the target by the surveillance system and the position locating system while within the area.

* * * * *